United States Patent [19]

Jones

[11] 4,144,784

[45] Mar. 20, 1979

[54] SAFETY GUARD FOR MANUAL FOOD SLICER

[75] Inventor: Frank W. Jones, Wilmington, Del.

[73] Assignee: Redco, Inc., Del.

[21] Appl. No.: 880,898

[22] Filed: Feb. 24, 1978

[51] Int. Cl.[2] ..... B26D 4/20; B26D 4/18

[52] U.S. Cl. ..... 83/425.3; 83/431; 83/733; 83/858

[58] Field of Search ..... 83/425.3, 425.2, 431, 83/733, 544, 860, 701, 858

[56] References Cited

U.S. PATENT DOCUMENTS

| | | | |
|---|---|---|---|
| 3,605,839 | 9/1971 | Gerson | 83/425.3 |
| 3,605,840 | 9/1971 | Morrett | 83/425.3 |
| 3,774,490 | 11/1973 | Gerson | 83/425.3 |
| 3,948,132 | 4/1976 | Camp | 83/425.3 |

*Primary Examiner*—Donald R. Schran
*Attorney, Agent, or Firm*—Connolly and Hutz

[57] ABSTRACT

A guard for preventing the operator's fingers from contacting the sharp edges of a parallel rack of blades in a food slicer, such as a tomato slicer is provided by a set of parallel planar segments intermeshed between and extending slightly in front of the sharp edges of the blades when the pusher is deployed away from the blades in position for introducing the object (tomato) to be sliced between the pusher and blades. A latch, such as a gravity latch, holds the assembly in the open guarded position until the tomato is introduced and the latch is released. In a rotary slicer a small portion of the blades adjacent the pusher are unguarded to facilitate introduction and prescoring of the tomato.

7 Claims, 4 Drawing Figures

SAFETY GUARD FOR MANUAL FOOD SLICER

BACKGROUND OF THE INVENTION

Various manual food slicers have long been in existence utilizing racks of sharp parallel cutting blades and pushers having parallel planar segments which intermesh between the blades to push food objects through them in a slicing action. The racks of parallel blades are extremely sharp and the operator's fingers are liable to become cut or nicked on them. Examples of such slicers are described in U.S. Pat. Nos. 3,605,839 and 3,774,490. The objects to be sliced are guided by hand against the sharp blades sometimes to the extent of prescoring. An object of this invention is to provide a safety guard for such a slicer. Another object is to provide such a simple and economical safety guard.

SUMMARY OF THE INVENTION

In accordance with this invention, a guard for preventing the operator's fingers from contacting the sharp edges of a parallel rack of blades in an open food slicer in position for receiving the food object between the pusher and blades has a set of auxiliary parallel planar segments intermeshed between and extending slightly in front of the blades when the pusher is deployed away from the blades in position for introducing the object to be sliced between them. A latch, such as a gravity stop, holds the assembly in the open guarded position until it is manually released. The auxiliary planar segments are, for example, provided by bent spacer pieces between the pusher segments or extensions thereof. A small portion of the blades adjacent the pusher may be left unguarded to facilitate introduction and prescoring of the object. A carrying handle on top of the rack of blades may also provide a convenient pistol grip for triggering the latch and also prevent it from being knocked known open.

DESCRIPTION OF THE DRAWINGS

Novel features and advantages of the present invention will become apparent to one skilled in the art from a reading of the following description in conjunction with the accompanying drawings wherein similar reference characters refer to similar parts and in which.

DESCRIPTION OF THE PREFERRED EMBODIMENT

Figure 1:
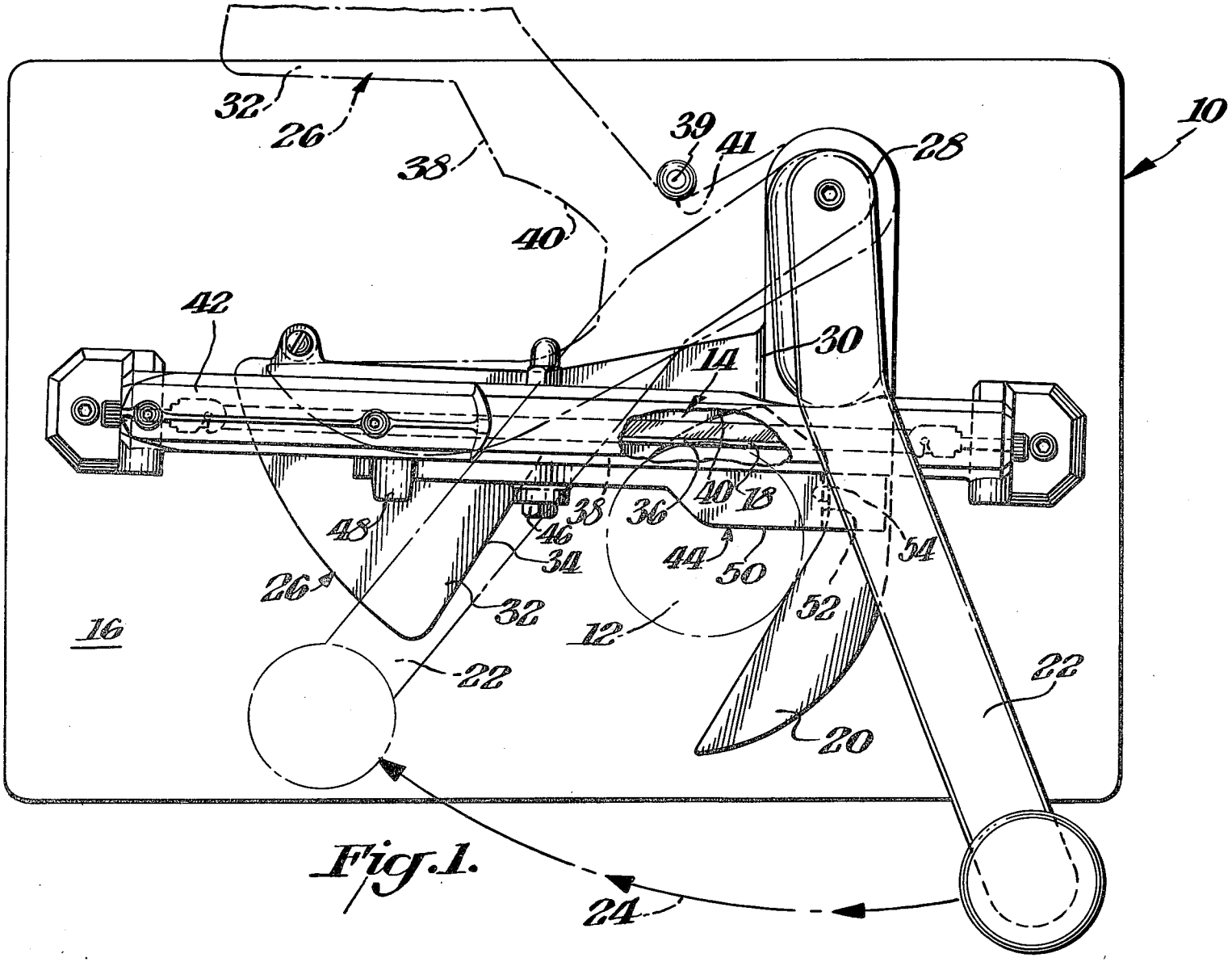
FIG. 1 is a top plan view of one embodiment of this invention with the open position shown in solid outline and the closed position in phantom outline.
Figure 2:
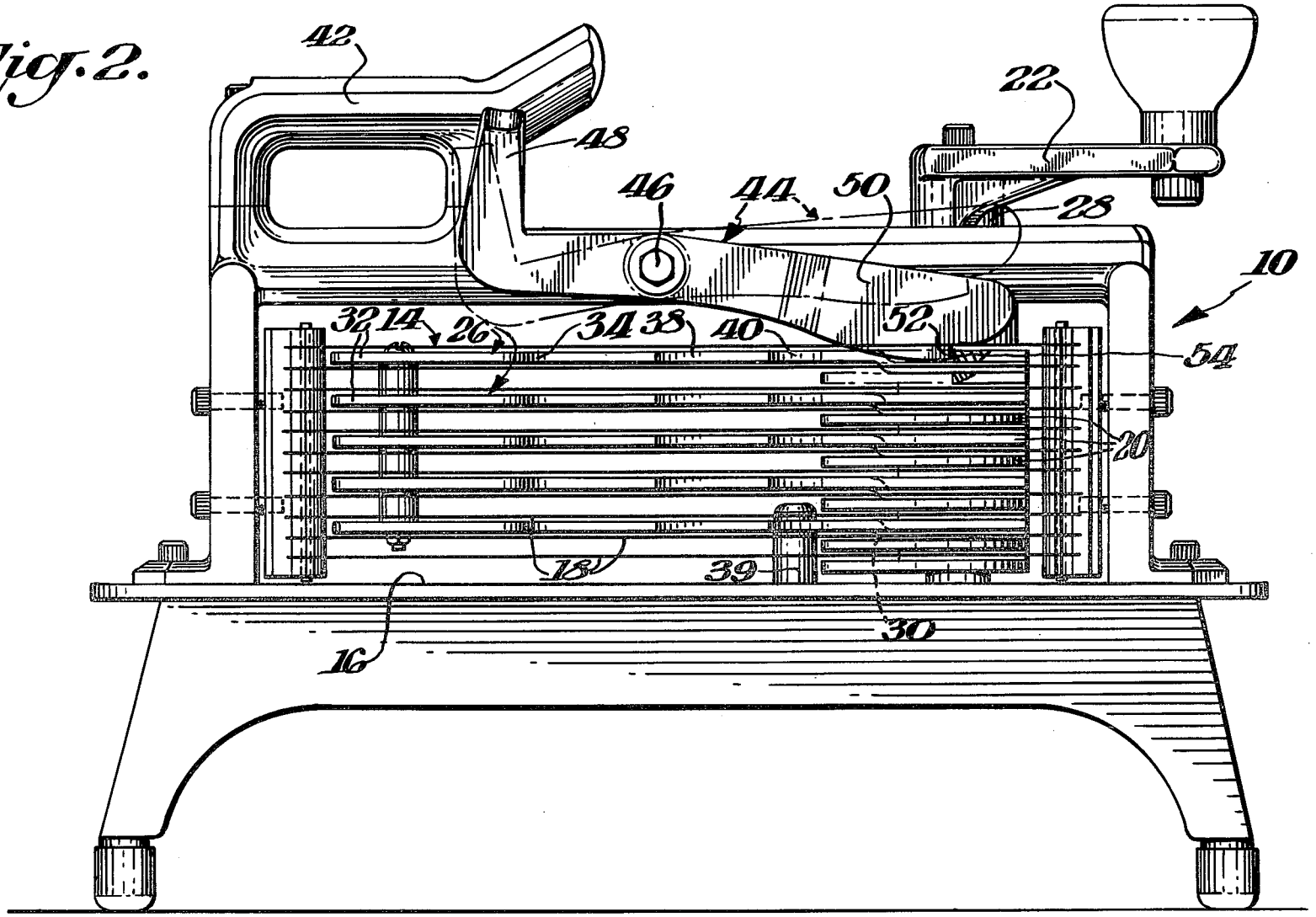
FIG. 2 is a front view in elevation of the embodiment shown in FIG. 1 in the open position with the latch shown in both latched and unlatched positions.
Figure 3:
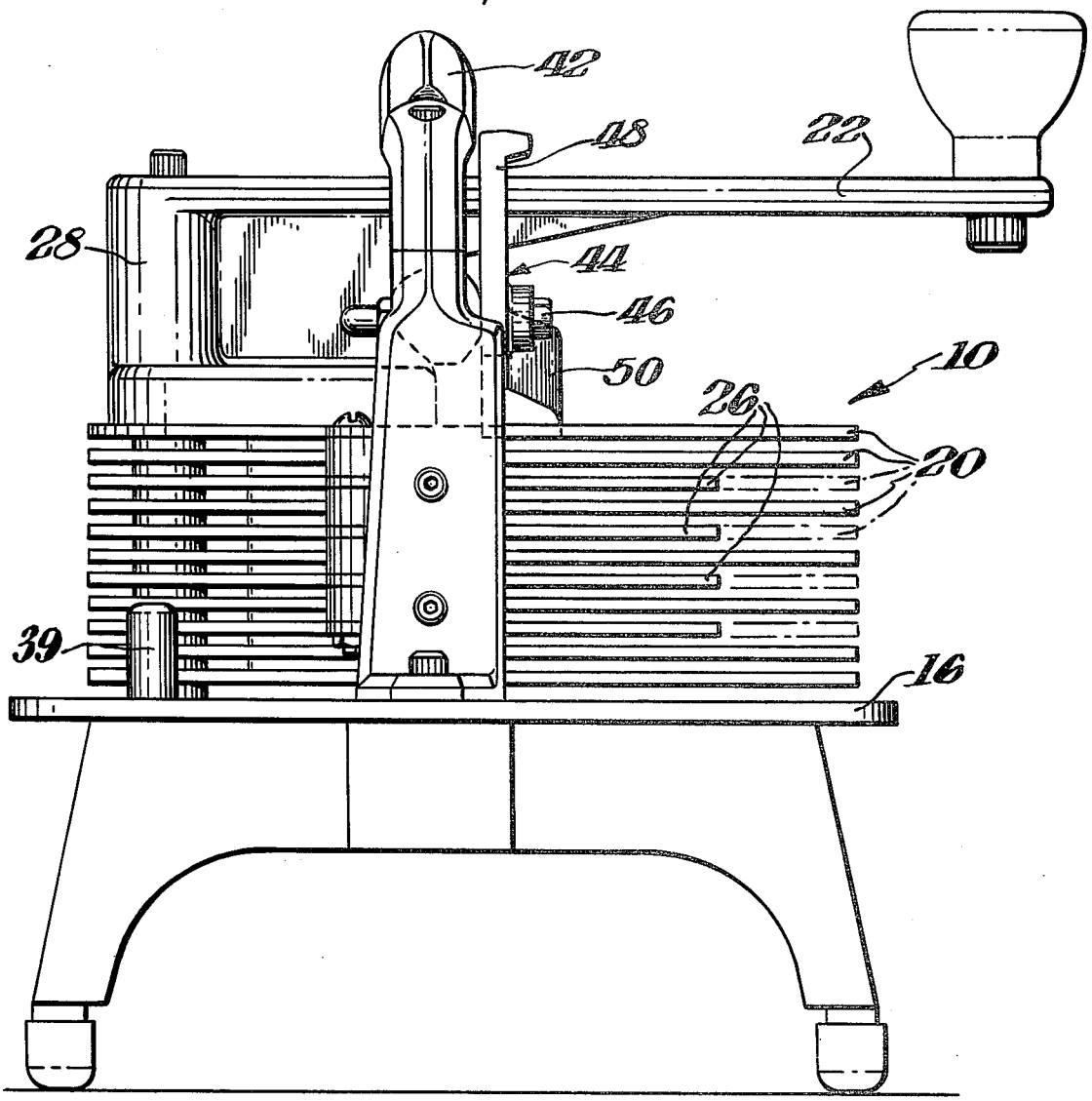
FIG. 3 is a left end elevational view of the embodiment shown in FIGS. 1 and 2.

In FIGS 1-3 is shown a tomato slicer 10 of the type described in U.S. Pat. No. 3,605,839. Its cutting action is substantially similar to that described in the patent and the only essential differences are in the addition of the safety guard and latch features. The slicing action, therefore, essentially involves pushing a tomato 12 through a tensioned rack of sharp cutting blades 14, which are supported on a table 16. Rack of blades 14 have sharp cutting edges 18, which are liable to cut or nick the fingers of an operator at the slightest touch. In slicing a soft tomato 10, it is advantageous to manually push the tomato against sharp blade edges 18 to prescore the tomato before pressure is applied by parallel array of planar pusher segments 20 against the tomato to force it against and between the sharp blade edges 18 by rotation of handle 22 in the direction of arrow 24.

Figure 4:
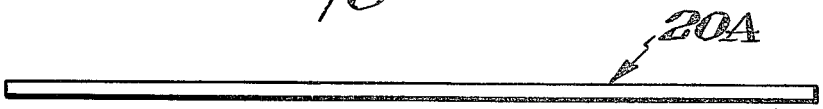
FIG. 4 is a front elevational view of a unitary blade guard and pusher segment.

Sharp edges 18 are shielded by a parallel array of auxiliary planar segments 26 attached to the boss 28 of the assembly of pusher segments 20. Parallel auxiliary segments 26 are aligned with pusher segments 20 for insertion between blade edges 18. Auxiliary segments 26 are, for example, fabricated as the spacers between pusher segments 20, as shown in FIG. 2 and have bends 30 intermediate them to align them with pusher segments 20. As shown in FIG. 4, auxiliary segments 26 may also be made integral with pusher segments 20, which would not require any bends in integral guard-pusher segments 20A.

As shown in FIG. 1, particularly in phantom outline auxiliary planar segments 26 have a triangular shaped outer portion 32, which extends a considerable distance through and in front of blade edges 18 when pusher segments 20 are deployed in the open position for receiving a tomato 12. The inner edges 34 of triangular portion 32 help guide tomato 12 against exposed blade portion 36 accessible just past intermediate segment portion 38, which also shields sharp blade edges 18 in the open position shown in FIG. 1. Curved cutout portion 40 of segments 26 leaves the contiguous blade edges 18 accessible for prescoring the tomato, which is pushed against them in prescoring soft tomatoes with the rest of the blade edges being shielded to prevent cutting or nicking the operator's fingers. When handle 22 is rotated clockwise to its phantom outline position in the direction of arrows 24, auxiliary segment 26 move ahead of tomato 12 past sharp blade edges 18 to fully expose them for cutting the tomato. Stop pin 39 extending from the surface of table 16 engages the leading edge 41 on the auxiliary planar segment 26, thereby terminating the slicing and the tomato slices are removed from between the phantom outline position of auxiliary segments 26 and the rear of blade rack 14 as shown in FIG. 1.

FIG. 2 shows carrying handle 42 on top of blade rack 14. It also shows gravity-biased latching lever 44 connected to the upper side of blade rack 14 by pivot pin 46. Lever 44 has an upwardly extending actuating arm 48 disposed adjacent handle 42. They, therefore, cooperate like a pistol grip and trigger for opening latching lever 44. Lever 44 has a lateral leg 50, having a locking recess 52, which engages side 54 of the top pusher segment 20 to lock it in the open position as shown in full outline in FIG. 1.

When an operator has a tomato inserted in place and ready to slice, he actuates trigger 48 by pushing it downwardly to lift locking recess 52 off the side 54 of upper pusher segment 20 to free it for clockwise rotation with operating handle 22. When trigger 48 is released, gravity-biased latching lever 44 and the locking recess 52 toward the lock position.

I claim:

1. A safety guard for a manual food slicer comprising a base frame, a parallel rack of blades having sharp edges mounted on the base frame, a pusher having a parallel array of planar segments, movable connecting means mounting the pusher segments on the base frame for movement from an open position deployed in front of the sharp edges of the blades to the closed positions in which the segments are intermeshed between the blades for receiving an object to be sliced between them in the open position and for pushing the object in a slicing action through the blades in closed positions, a set of auxiliary parallel planar segments connected to the array of pusher segments and leaving a space therebetween large enough to allow the object to be sliced to be readily inserted between the pusher segments and the auxiliary segments, and the auxiliary segments having relatively blunt edges disposed in front of the sharp edges of the blades when the pusher and auxiliary pusher segments are deployed in the open position whereby they prevent an operator's fingers from contacting portions of the sharp edges of the blades in front of which the blunt edges are disposed.

2. A food slicer as set forth in claim 1, wherein a cutout is provided in the blunt front edges of the auxiliary segments adjacent the pusher segments which exposes portions of the sharp edges of the blades adjacent the pusher to permit prescoring of the object.

3. A food slicer as set forth in claim 2, wherein the auxiliary segments have an outer triangular section.

4. A food slicer as set forth in claim 1, wherein the auxiliary segments comprise spacers between the pusher segments and have an intermediate bend for aligning the auxiliary segments with spaces inbetween the blades.

5. A food slicer as set forth in claim 1, wherein the auxiliary segments are integral with the pusher segments and in line therewith.

6. A food slicer as set forth in any one of claims 1 through 5, wherein a manually-operable latch is mounted on the slicer for holding the pusher and auxiliary segments in an open guarded position.

7. A food slicer as set forth in claim 6, wherein a carrying handle is provided adjacent the manually-operable latch whereby they cooperate with each other in actuation of the latch and prevent it from being accidentally knocked open.

* * * * *

UNITED STATES PATENT AND TRADEMARK OFFICE

CERTIFICATE OF CORRECTION

PATENT NO. : 4,144,784

DATED : March 20, 1979

INVENTOR(S) : Frank W. Jones

It is certified that error appears in the above-identified patent and that said Letters Patent are hereby corrected as shown below:

Column 1, line 37, delete "known"

Column 1, line 37, after "being" insert -- accidentally --.

Signed and Sealed this

Nineteenth Day of June 1979

[SEAL]

*Attest:*

RUTH C. MASON
*Attesting Officer*

DONALD W. BANNER
*Commissioner of Patents and Trademarks*